US006328192B1

(12) United States Patent
Sundara et al.

(10) Patent No.: US 6,328,192 B1
(45) Date of Patent: Dec. 11, 2001

(54) GOLF BAG WITH AN INTEGRATED BACK PAD AND DUAL SHOULDER STRAP ASSEMBLY

(75) Inventors: Chloe H. Sundara, Mill Valley; John M. Williams, San Francisco, both of CA (US)

(73) Assignee: Sundara Industries, Ltd., San Francisco, CA (US)

( * ) Notice: Subject to any disclaimer, the term of this patent is extended or adjusted under 35 U.S.C. 154(b) by 0 days.

(21) Appl. No.: 09/685,493

(22) Filed: Oct. 10, 2000

Related U.S. Application Data

(60) Provisional application No. 60/188,136, filed on Mar. 9, 2000.

(51) Int. Cl.[7] ..... A45F 3/04

(52) U.S. Cl. ..... 224/645; 224/644; 224/627; D3/255

(58) Field of Search ..... 224/153, 627, 224/642, 643, 644, 645, 259; D3/216, 217, 255

(56) References Cited

U.S. PATENT DOCUMENTS

| | | | |
|---|---|---|---|
| D. 362,752 | | 10/1995 | Steurer . |
| D. 387,556 | | 12/1997 | Beebe et al. . |
| D. 409,838 | | 5/1999 | Steurer . |
| D. 411,039 | | 6/1999 | Reimers et al. . |
| D. 411,666 | | 6/1999 | Reimers et al. . |
| D. 412,396 | | 8/1999 | Reimers et al. . |
| D. 413,019 | | 8/1999 | Reimers . |
| 1,570,500 | | 1/1926 | Kennedy . |
| 1,753,073 | | 4/1930 | Troften . |
| 1,809,120 | | 6/1931 | Hall . |
| 1,816,262 | | 7/1931 | Ritter . |
| 1,951,492 | | 3/1934 | Schneider . |
| 2,224,568 | | 12/1940 | Altorfer . |
| 2,256,521 | | 9/1941 | Kirkpatrick, et al. . |
| 2,533,440 | | 12/1950 | Endee . |
| 2,820,498 | | 1/1958 | Endee . |
| 2,853,111 | | 9/1958 | Williams . |
| 3,622,056 | | 11/1971 | Droeger . |
| 3,882,914 | | 5/1975 | Strutz . |
| 4,018,369 | | 4/1977 | Jaeger . |
| 4,074,839 | | 2/1978 | Wood et al. . |
| 4,155,387 | | 5/1979 | Costa . |
| 4,182,470 | | 1/1980 | Atkinson . |
| 4,487,347 | | 12/1984 | Zegar . |
| 4,796,752 | | 1/1989 | Reimers . |
| 4,911,347 | | 3/1990 | Wilhite . |
| 5,038,984 | * | 8/1991 | Izzo ..... 224/645 |
| 5,042,654 | | 8/1991 | Jones . |
| 5,042,703 | | 8/1991 | Izzo . |
| 5,042,704 | | 8/1991 | Izzo . |
| 5,064,108 | | 11/1991 | Headley . |
| 5,112,068 | | 5/1992 | Liao et al. . |
| 5,215,239 | | 6/1993 | Walters, Jr. . |
| 5,269,449 | | 12/1993 | Sattler . |

(List continued on next page.)

*Primary Examiner*—Gregory M. Vidovich
(74) *Attorney, Agent, or Firm*—Blakely, Sokoloff, Taylor & Zafman LLP

(57) ABSTRACT

A golf bag incorporating an integrated back pad and dual straps is described. The back pad comprises two elements: an upper back pad member and a lower back pad member. The lower back pad member acts as an intermediate between the back of the golfer and the surface of the golf bag when being carried. The upper back pad member extends away from the golf bag body and provides additional back support to the golfer. Both dual straps are attached to the upper back pad member at one end and to either the golf bag body or the lower back pad member at the other end. Because the straps attach to the upper back pad member and are typically spaced from each other, the golfer can more intuitively determine both which shoulder strap to place over his shoulder first and which end of the shoulder strap corresponds to the portion of the shoulder strap that will rest on the golfer's shoulder.

25 Claims, 6 Drawing Sheets

U.S. PATENT DOCUMENTS

| | | | | |
|---|---|---|---|---|
| 5,348,205 | | 9/1994 | Steurer . | |
| 5,419,473 | | 5/1995 | Lamar . | |
| 5,429,288 | | 7/1995 | Sattler . | |
| 5,551,561 | | 9/1996 | MacRae et al. . | |
| 5,558,259 | | 9/1996 | Izzo . | |
| 5,593,077 | | 1/1997 | Izzo . | |
| 5,636,778 | | 6/1997 | Jones et al. . | |
| 5,887,833 | | 3/1999 | Sundara et al. . | |
| 5,954,254 | * | 9/1999 | Maeng | 224/645 |
| 5,954,255 | | 9/1999 | Beebe et al. . | |
| 5,975,292 | | 11/1999 | Sundara et al. . | |
| 5,979,727 | | 11/1999 | Steurer . | |
| 6,006,974 | * | 12/1999 | Varney et al. | 224/645 |

* cited by examiner

GOLF BAG WITH AN INTEGRATED BACK PAD AND DUAL SHOULDER STRAP ASSEMBLY

This Application claims benefit of Provisional Application Ser. No. 60/188,136 filed Mar. 9, 2000.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The invention relates generally to golf equipment. More specifically, the invention relates to golf bags having dual carrying straps.

BACKGROUND OF THE INVENTION

Golf bags are typically carried by a golfer using either a single strap slung over one shoulder or dual shoulder straps in which a strap is slung over each shoulder of the golfer. The dual shoulder strap configuration has proven advantageous as the weight of a loaded golf bag is distributed over two shoulders instead of one, significantly reducing the load on any particular shoulder of the golfer, and increasing the golfer's comfort.

Current dual strap designs have focused primarily on manner of attachment and configuration of the straps relative to each other. They do not focus significantly on the manner in which the golf bag enclosure interfaces with the back of the golfer when the bag is being carried. Several dual strap golf bags have back pad elements but they are separate and distinct from the shoulder strap system and little consideration seems to have been given to the manner in which the strap members interface with the back of the golfer.

Many current dual strap implementations may appear to the golfer as a complex hodgepodge of straps and fabric webbing interconnected with each other by rings and buckles. Consequently, the manner in which a golf bag is to be picked up (i.e., which strap of the two is to be slung over a shoulder first before slinging the second strap over the other shoulder) is not obvious or intuitive.

SUMMARY OF THE INVENTION

A golf bag incorporating an improved dual strap carrying system is described. According to one embodiment of the invention, the golf bag comprises a back pad having an upper back pad element and a lower back pad element. The lower back pad element has a back mounting surface, which is connected with a portion of the outer surface of the golf bag enclosure's body. The upper back pad element interfaces with the golf bag body at one edge and extends away from the golf bag body. Two shoulder straps are attached with the upper back pad element at one end and to the golf bag enclosure at the other end.

In other embodiments of the invention, the golf bag may include a fully integrated back pad/shoulder strap assembly which may be adjusted relative to its positioning on the golf bag enclosure. In this embodiment, the shoulder straps each have one end connected with the upper back pad element and one end connected with the lower back pad element. The lower back pad element is adjustably connected with the golf bag body by a hook and loop material, such as Velcro™, a rail and slide arrangement, or other means.

BRIEF DESCRIPTION OF THE DRAWINGS

The present invention is illustrated by way of example and not by way of limitation in the accompanying figures briefly described below. Reference numerals within a figure refer to similar elements in the other figures unless otherwise noted.

DETAILED DESCRIPTION

A golf bag incorporating a novel integrated back pad and shoulder strap assembly is described herein. In the following description, for purposes of explanation, specific details are set forth in order to provide a thorough disclosure of the present invention. It will be apparent, however, to those skilled in the art that the present invention may be practiced without some of the specific details.

A GOLF BAG WITH AN INTEGRATED BACK PAD AND DUAL SHOULDER STRAP ASSEMBLY

Figure 1A:
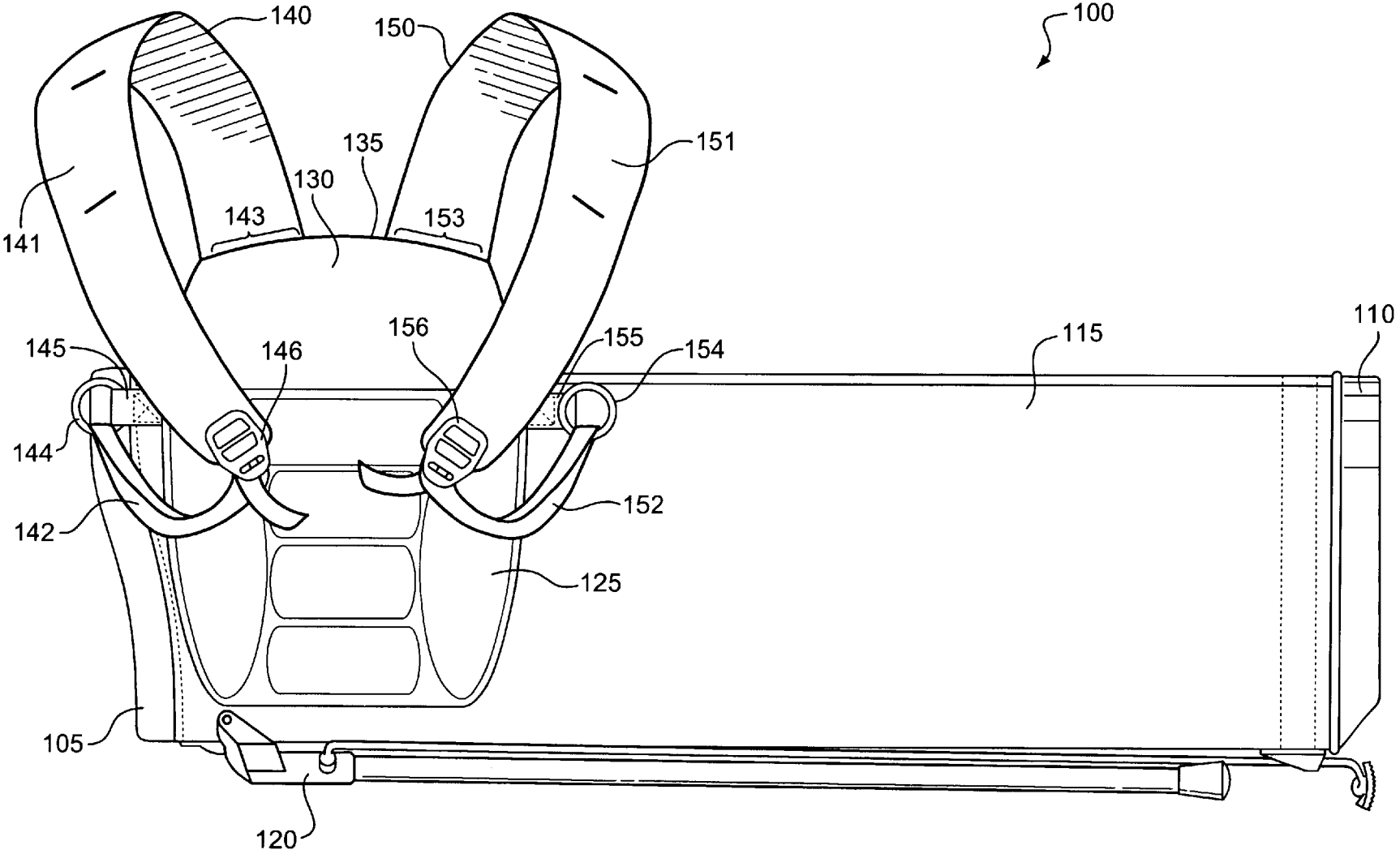
FIGS. 1A, 1B and 1C are illustrations of a preferred embodiment golf bag incorporating the improved dual shoulder strap design.
Figure 1B:
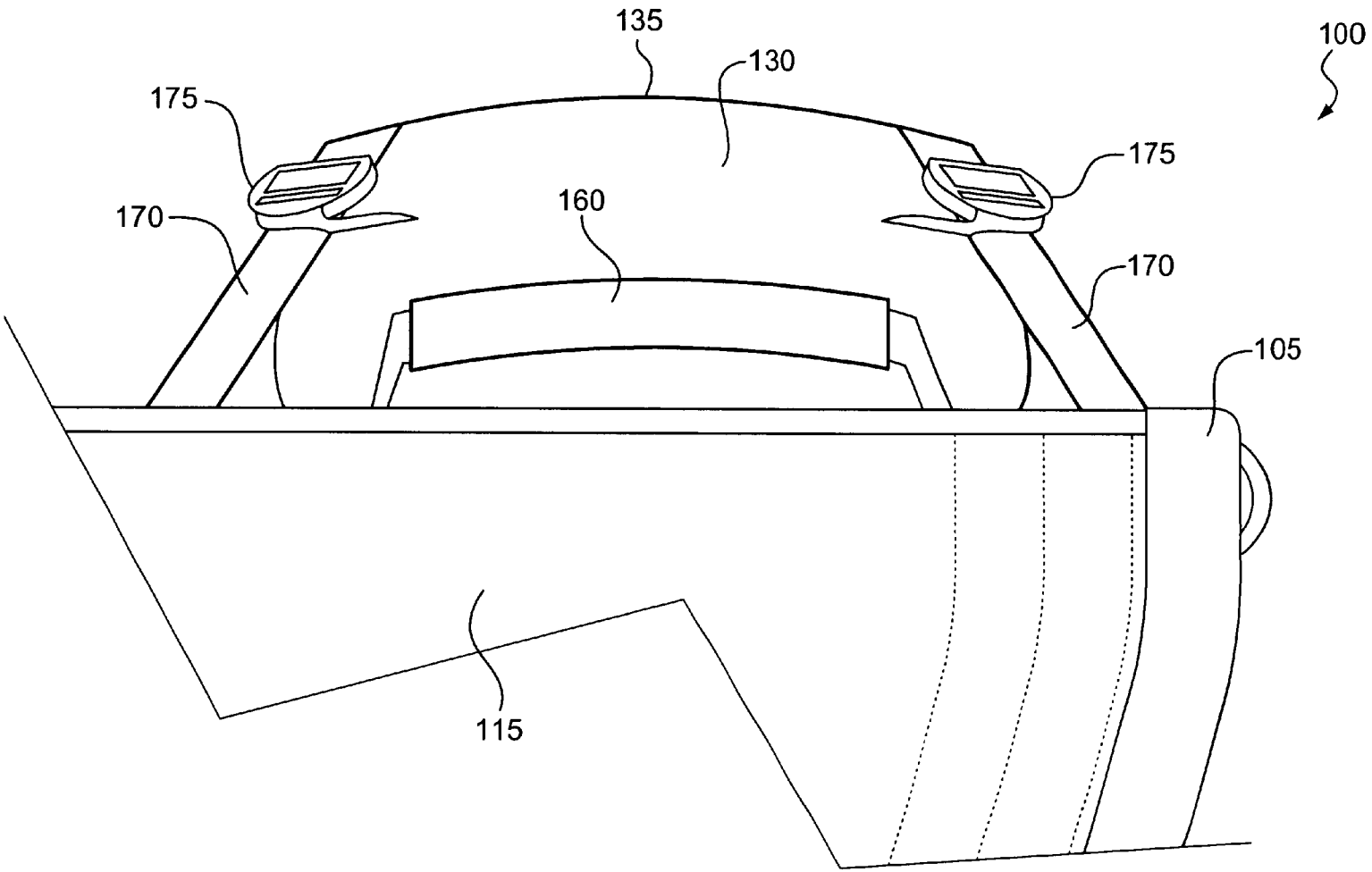
Figure 1C:
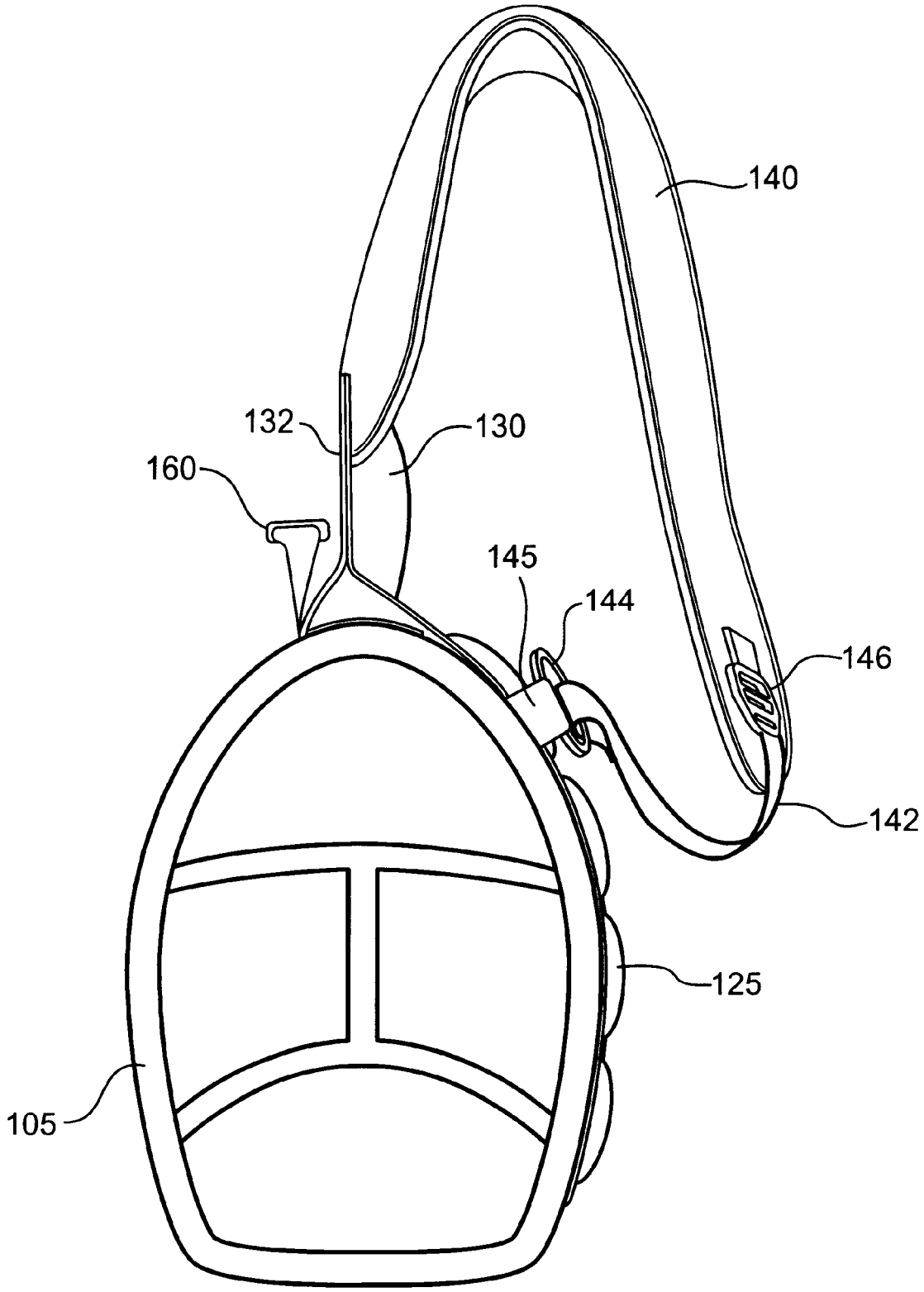

FIGS. 1A, 1B and 1C depict a golf bag incorporating a preferred embodiment of the back pad/dual strap assembly. The golf bag 100 illustrated is a stand bag incorporating a retractable support stand 120, however the back pad/dual strap assembly may be incorporated onto many different golf bag types. A typical golf bag enclosure comprises a closed base 110, a top 105 with one or more openings through which golf clubs may be inserted, and an elongated body 115 disposed there-between. Attached to the enclosure are one or more means for carrying the enclosure, such as a handle 160 or a shoulder strap assembly.

The back pad portion of the assembly typically comprises two elements: a lower back pad member 125 and an upper back pad member 130. The lower back pad member 125 is attached to the surface of the golf bag body 115 and is an intermediate between the golf bag and the back of the golfer when the bag is being carried in the preferred manner. The lower and upper back pad members 125 and 130 are typically comprised of fabric containing padding to maximize the golfer's comfort, however the back pads may be made from any number of suitable materials in any suitable manner. For instance, the back pads could be made of a resilient, compression-molded foam material. The padding may be configured in any number of ways to maximize the distribution of the load over the greatest area of the golfers back. In the preferred embodiment, the lower back pad 125 is sewn directly to the outer surface of the body, but in alternative embodiments, the lower back pad may be attached to the bag in any number of ways including, but not limited to, rivets, snaps, zippers, clips, buckles and adhesives. Furthermore, the pad could be integral with the sidewall of the golf bag body 115, fabricated from the fabric or other material that comprises the outside wall of the body 115. Additionally, the lower back pad member 125 may be adjustably fixed to the golf bag so that the orientation and location of the back pad relative to the enclosure may be adjusted as-necessary to maximize golfer comfort. In at least one embodiment, the pad may be fixed to the golf bag using a hook and loop material such as Velcro™ permitting the user to remove the back pad from the golf bag enclosure if desired.

The upper back pad member 130 intersects with the lower back pad member 125 and extends away from the golf bag enclosure as shown most clearly in FIG. 1C. The surface of the upper back pad member 130 intended to contact the back of the golfer is typically padded to maximize golfer comfort when carrying the golf bag. As with the lower back pad member 125 and the golf bag body 115, the upper back pad member is comprised of a fabric material, such as nylon fabric. The upper back pad member 130 may also comprise a rigid element 132 to serve one or more functions such as providing separation of the shoulders straps 140 and 150 where they interface with the upper back pad 130, providing backing for the padding and causing the upper back pad member 130 to extend away from the body 115.

In the preferred embodiment, two adjustable straps 170 made of webbing are attached to the enclosure at one end and the upper back pad member 130 on the other. Through the use of provided buckles 175, the length of the straps may be adjusted as necessary to vary the angle of the upper back pad member with the body at the location where it intersects the body 115 and the lower back pad member 125. The adjustable straps 170 also act to help transfer load from the golf bag enclosure to the shoulder straps 140 and 150 to maintain the orientation of the bag and maximize the area of the back pad that is in contact with the golfer's back. Furthermore, by tightening one adjustable strap 170 more than the other adjustable strap 170, the longitudinal axis of the bag can be made to tilt slightly relative to the golfer. For example, if the strap 170 closest to the top 105 is adjusted so that its length is shorter than the other strap 170, the golf bag will tilt slightly when worn by the golfer such that the bottom 110 will be closer to the ground than the top 105. Typically, the adjustable straps 170 are sewn to both the upper back pad member 130 and the enclosure body 115, although other means of attaching the adjustable straps 170 are envisioned, such as riveting.

The shoulder straps 140 and 150 are attached to the edge 135 of the upper back pad member 130 farthest away from the surface of the golf bag body 115 at locations 143 and 153 respectively. Typically, locations 143 and 153 will be spaced apart from each other. The back pad/strap assembly has the look of a strap assembly configuration that might be found on a backpack. Because of this mounting configuration reminiscent of back pack shoulder straps, the golfer may more intuitively determine which shoulder strap of the two to place over his shoulder first when lifting the bag into the carrying position. Furthermore, it is very clear based on the shoulder strap's connection with the upper back pad which end of the shoulder straps are to rest on the golfers shoulder as opposed to the portion of the strap that is to pass under the golfer's arms. In the preferred embodiment, the padded portion of straps 141 and 151 are sewn directly to the upper back pad member 130. However, other commonly known methods of attaching shoulder straps 140 and 150 to the upper back pad member are also. contemplated. The other ends of shoulder straps 140 and 150 are attached to the golf bag enclosure at locations 145 and 155 respectively. Location 145 is typically proximate the top 105 of the enclosure and spaced circumferentially from the location at which the upper back pad member 130 is incident with the. body. Location 155 is located just below the lower back pad 125 in approximate axial alignment with location 145. Other mounting locations are envisioned. Generally, the mounting location 145 for the first strap 140 shall be at a longitudinal distance from the top 105, less or equal to the distance of the top to the edge of the lower back pad member 125 closest the top 105. The lower mounting location 155 is typically located a longitudinal distance from the top 105 equal to or greater than the distance from the top 105 to the edge of the lower back pad member farthest from the top 105. In the preferred embodiment, adjustable strap portions 142 and 152 of shoulder straps 140 and 150 are looped through ringed elements 144 and 154 and back through a buckle 146 and 156. attached to the padded strap portions 141 and 151. Accordingly, the overall effective length of shoulder straps 140 and 150 may be adjusted for a particular golfer.

A FIRST ALTERNATIVE EMBODIMENT BACK PAD/DUAL SHOULDER STRAP ASSEMBLY

Figure 2:
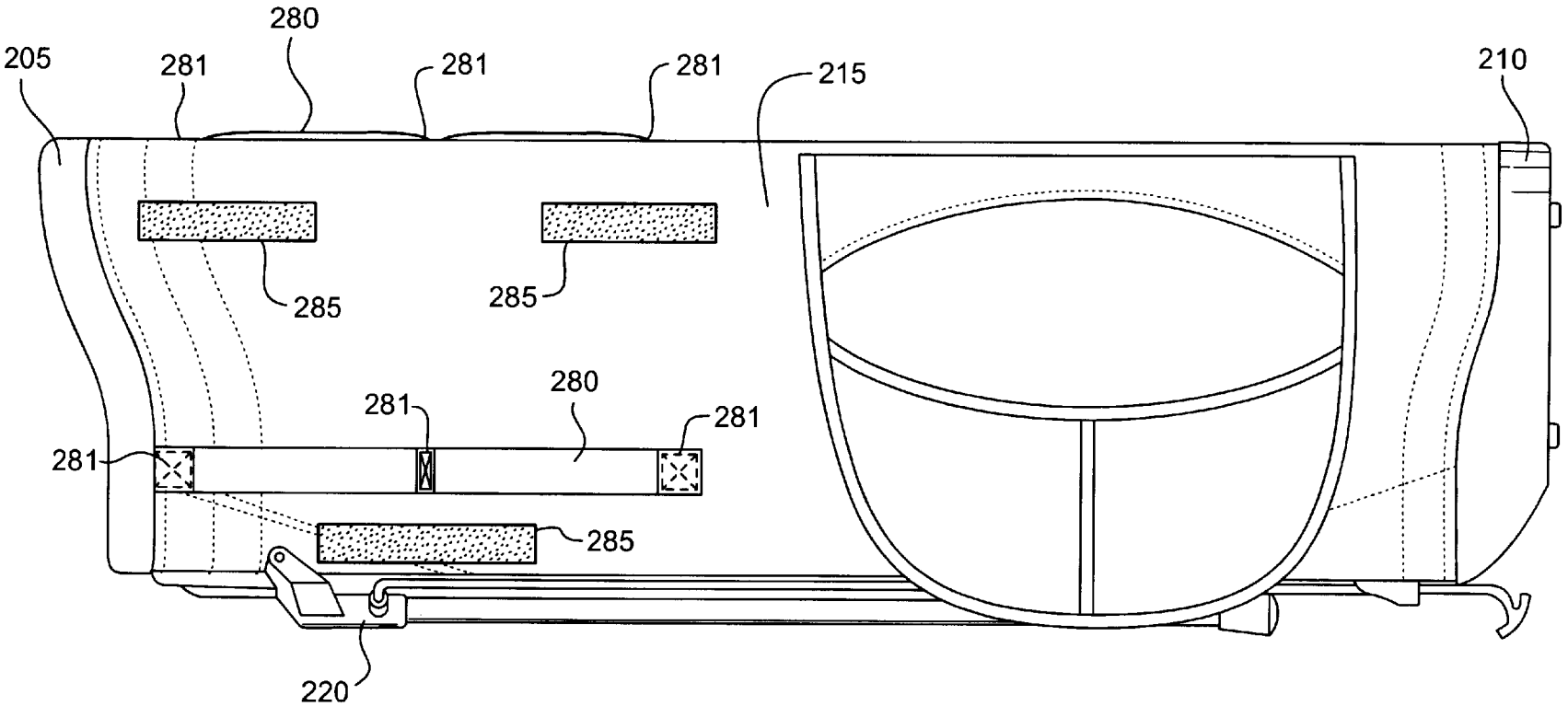
FIG. 2 is an illustration of a first alternative embodiment golf bag with the back pad/shoulder strap assembly removed.
Figure 3C:
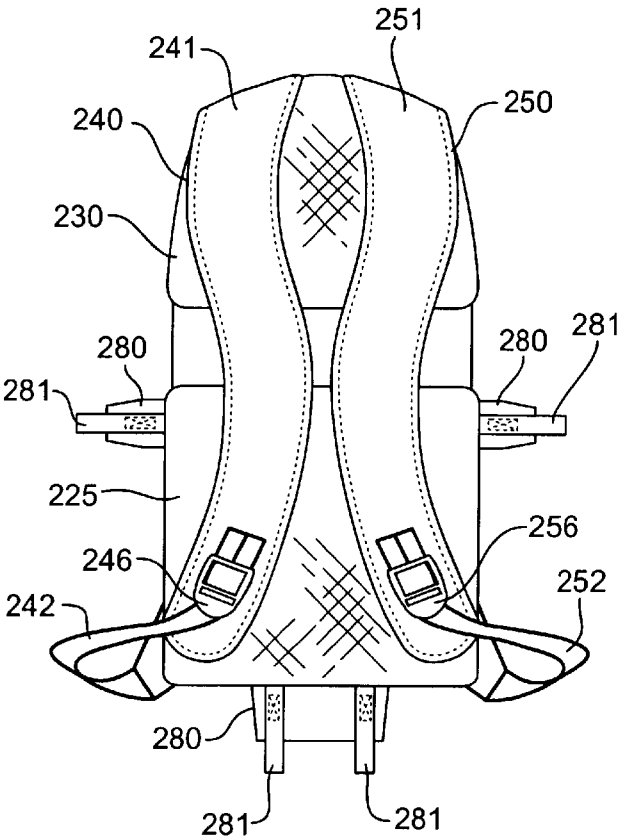
FIGS. 3A, 3B and 3C are illustrations of various views of the back pad/shoulder strap assembly for the first alternative embodiment.
Figure 3B:
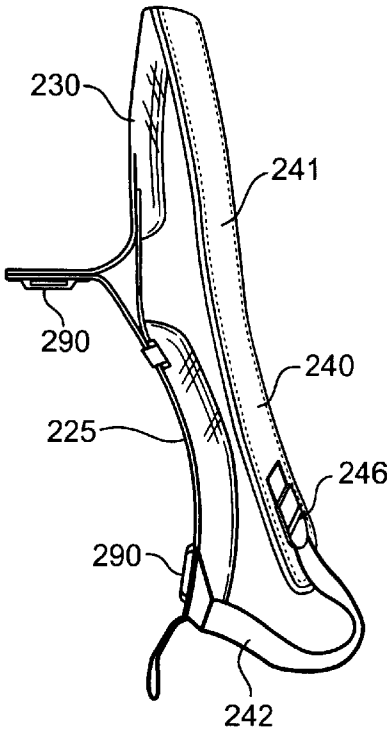
Figure 3A:
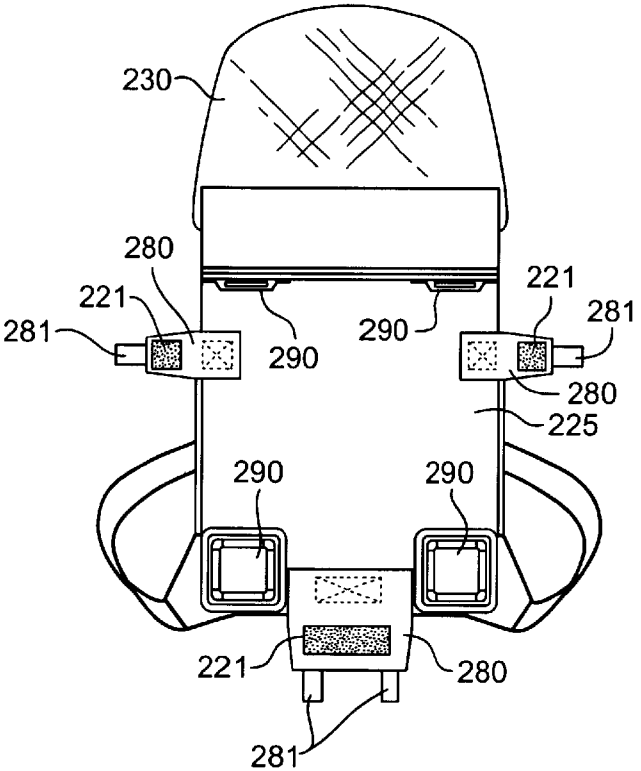

FIGS. 2 and 3 illustrate an alternative embodiment of the invention in which the back pad is completely integrated with the shoulder straps, and the integrated assembly may be positionally adjusted relative to its placement on the golf bag enclosure. In particular, FIG. 2 is an illustration of a typical golf bag enclosure that includes several additional elements that comprise an adjustment/connection system used to attach the dual strap assembly to the golf bag enclosure. FIG. 3 illustrates a completely integrated back pad and dual shoulder strap assembly along with additional elements that comprise the remainder of the adjustment/connection system.

The back pad comprises two portions: a lower back pad member 225 and an upper back pad member 230. Both members are padded to maximize the comfort of a golfer while carrying the golf bag. The lower back pad member 225 is attached to and against a portion of the outside surface of the golf bag body 215 by the adjustment/connection system, described in detail below. The lower back pad member 225 is an intermediary between the surface of the golf bag body 215 and the back of the golfer when the golf bag is being carried in the preferred manner.

The upper back pad member 230 interfaces with the lower back pad member 225 and extends away from the body 215 of the golf bag at a location proximate to the interface. A rigid or semi-rigid plastic plate may back the padded portion of the back pad to provide support for the padding material.

The first alternative embodiment incorporates an adjustment/connection system that permits the entire integrated assembly to be moved longitudinally along the length of the golf bag enclosure. Additionally, moderate adjustments in the generally perpendicular angular orientation of a back pad axis of symmetry relative to a longitudinal. axis of the golf bag enclosure may be made. The illustrated system incorporates four unit slides 290 sewed, riveted, or otherwise attached to the backside of the integrated assembly. Two slides 290 are located near the bottom of the lower back pad 225, and the other two slides are located on a flap of fabric material that extends from the back side of the integrated assembly at the proximate interface of the upper back pad 230 and the lower back pad 225. Corresponding to the unit slides 290 are a pair of webbing rails 280 attached to the golf bag body 215 at locations 281 by riveting, sewing, or other suitable means. The rails 280 receive the unit slides 290 and permit the movement of the integrated assembly longitudinally along at least a portion of the length of the body 215. Also, because the rails 280 are made of a flexible material such as fabric webbing, some measure of angular adjustment of the integrated assembly is afforded relative to a longitudinal axis of the bag. It is noted, as would be obvious to one of skill in the art, that other rail and slide mechanisms may be substituted for the ones described herein without substantially impacting the adjustability of the system.

Hook and loop material is utilized to secure the integrated assembly in place once it has been positioned on the golf bag body 215. Either the hook or loop portion 285 is attached to the body at one or more locations. The other of the hook or loop portion 221 is also attached to the back of the integrated assembly. In the illustrations, the amount of hook or loop material attached to the golf bag body 215 is greater than the amount attached to the integrated assembly to ensure that no matter where along the golf bag body 215 the integrated assembly is placed, it can be secured with the hook and loop material. It is noted that various variations on the locations of the hook and loop material are contemplated as would be obvious to one of skill in the art with the benefit of this disclosure. Additionally, other means may be utilized to secure the integrated assembly in place including, but not limited to, adjustable straps, buttons and snaps. Alternatively, the adjustment/connection system could be comprised primarily of hook and loop material without the rail and slide portions, such that the golfer would merely move the integrated assembly into the desired position and place the corresponding hook and loop portions in contact with each other to secure the integrated assembly to the body 215.

As can be seen in the Figures, the hook or loop portions 221 attach to the integrated assembly by way of flaps of fabric 280 attached to the edges of the back pad. Attached to these flaps 280 are pull straps 281. Advantageously, a golfer may adjust the position of the integrated assembly relative to the golf bag enclosure for maximum comfort and efficiency while wearing the loaded golf bag. First, the golfer places both arms through the shoulder straps and suspends the golf bag from his shoulders, against his back. The golfer then pulls the various pull straps 281 to release the hook or loop portion attached to the fabric flap 280 from its corresponding hook or loop portion attached to the golf bag body 215. Next, the golfer moves the integrated assembly along the webbing rails 280 until a position is determined in which the golf bag is properly balanced. Finally, the golfer pushes the fabric flap 280 with the hook or loop portion 281 back into the hook or loop portion 285 on the body 215 to secure the integrated assembly in place.

A SECOND ALTERNATIVE EMBODIMENT BACK PAD/DUAL SHOULDER STRAP ASSEMBLY

Figure 4B:
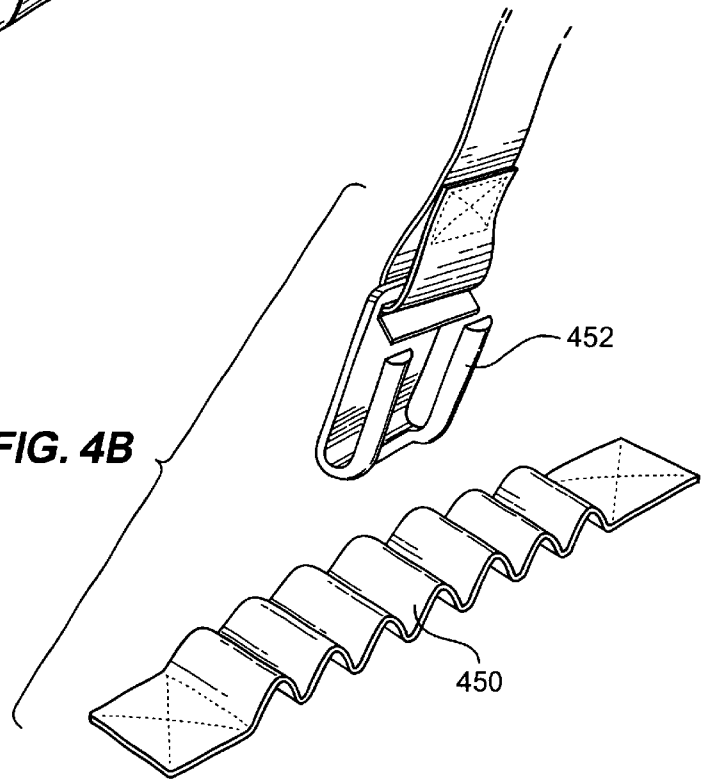
FIGS. 4A and 4B are illustrations of a second alternative embodiment golf bag incorporating a removable/adjustable back pad/shoulder strap assembly that is connected to the golf bag using a daisy chain strap and daisy chain clip combination.
Figure 4A:
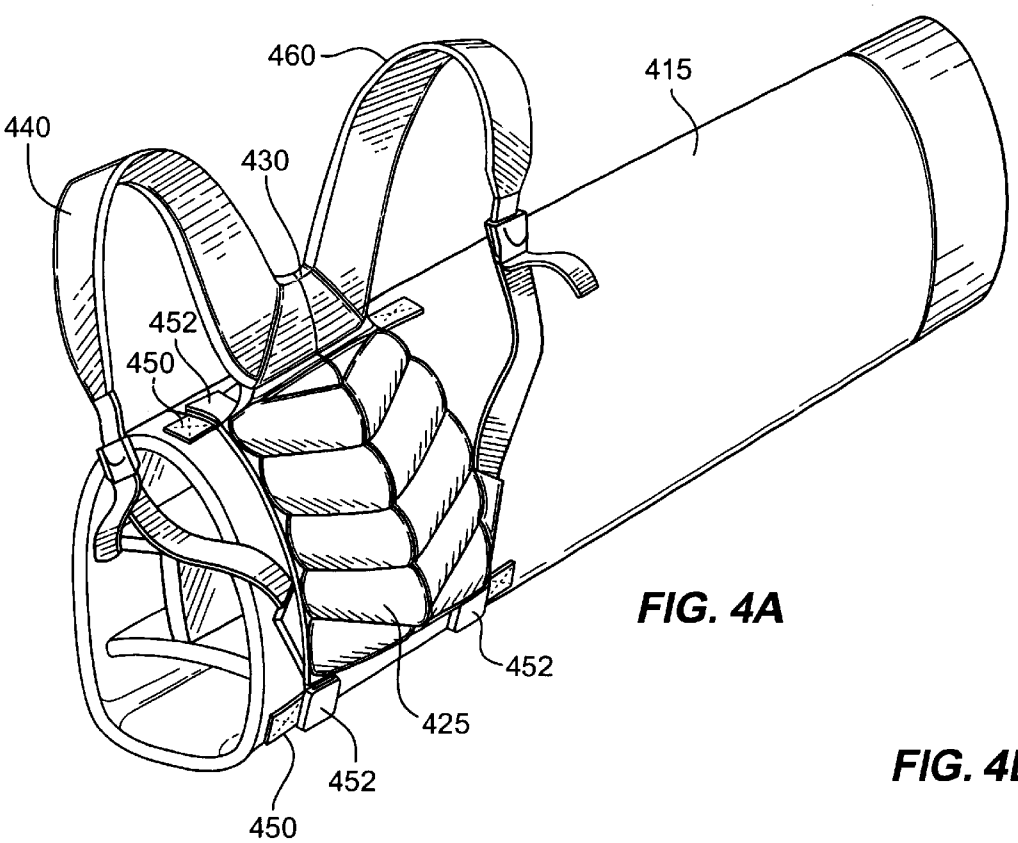

FIGS. 4A and 4B illustrate a second alternative embodiment of the invention. The back pad 425 and 430 is completely integrated with the shoulder straps 440 and 460, and the integrated assembly may be positionally adjusted relative to its placement on the golf bag enclosure via a daisy chain connection and adjustment system, as described below.

Webbing 450 is attached to the golf bag enclosure 415 at two locations, roughly corresponding to the top and bottom of the lower back pad 425 when the back pad/shoulder assembly is mounted to the golf bag. The webbing is arranged as consecutive loops in a daisy chain configuration as shown in FIG. 4B. In alternative versions, the webbing 450 may be replaced with any number of other suitable materials embodying the daisy chain configuration such as metal, solid plastic or leather.

Attached to the back pad assembly at the approximate four comers of the lower back pad 425 are four daisy chain clips 452, each clip having at least one prong that may be received by the daisy chain webbing 450. The clips 452 may be made of any number of suitable materials including plastic and metal. The clips 452 may be attached directly to the lower back pad 425 or they may be attached to webbing as shown in FIG. 4B that is attached to the back pad/shoulder strap assembly. The back pad/shoulder strap assembly is adjusted by moving the back pad/shoulder strap assembly along the golf bag and placing the clips 452 into the desired loops of the daisy chain webbing 452 to secure the assembly in the desired location.

OTHER ALTERNATIVE EMBODIMENTS

The invention has been described above in terms of a preferred embodiment and a first alternative embodiment. It will be evident that various modifications and changes may be made to the disclosed embodiments without departing from the broader spirit and scope of the invention, namely, an integrated back pad and dual shoulder strap assembly. For example, it is contemplated that the padded upper back pad member may not necessarily intersect with the lower back pad member. In other words, the upper back pad member to which the shoulder straps are attached may be separately attached to the golf bag body. Accordingly, it is understood that the figures and accompanying description thereof are to be regarded as illustrative rather than restrictive, and that the scope of this invention is limited only by the claims presented below.

What is claimed is:

1. A golf bag comprising:

an enclosure, the enclosure having a top and a base at opposite ends of the enclosure with a body coupled there-between, the body having an outside surface;

a back pad, the back pad comprising a lower back pad element, and an upper back pad element, the lower back pad element having a back mounting surface, the back mounting surface connected with the body, the upper back pad element interfacing with and extending away from the body, a first shoulder strap having a first shoulder strap first end and a first shoulder strap second end, the first shoulder strap first end connected with the enclosure, and the first shoulder strap second end connected with the upper back pad element; and a second shoulder strap having a second shoulder strap first end and a second shoulder strap second end, the second shoulder strap first end connected with the upper back pad element, and the second shoulder strap second end connected with the enclosure, said lower back pad element being connected with the body such that it covers a portion of the outside surface which would otherwise contact the back of a person when the bag is carried on the person by the first and second shoulder straps.

2. The golf bag of claim 1, wherein the upper back pad element intersects with the lower back pad element.

3. The golf bag of claim 2, wherein at least a portion of the first and second shoulder straps are padded.

4. The golf bag of claim 2, wherein the first and second shoulder straps are adjustable.

5. The golf bag of claim 2, wherein the upper back pad element is stiffened by a plate of rigid or semi-rigid material.

6. The golf bag of claim 2, wherein the first shoulder strap first end is connected with the enclosure at a location proximate the top.

7. The golf bag of claim 2, wherein at least one adjustable strap is connected with the upper back pad element and a location on the body.

8. The golf bag of claim 2, wherein two adjustable straps are connected with the upper back pad element and respective locations on the body.

9. The golf bag of claim 2, wherein the upper back pad element comprises an edge located farthest from the body, and the first shoulder strap second end is connected with the upper back pad element at a first location substantially along the farthest edge.

10. The golf bag of claim 9, wherein the second shoulder strap first end is connected with the upper back pad element at a second location substantially along the farthest edge.

11. The golf bag of claim 10, wherein the first location is closer to the top than the second location.

12. The golf bag of claim 11, wherein the first and second locations do not overlap.

13. The golf bag of claim 2, further comprising a handle, the handle being connected with the body at a location adjacent to the upper back pad member.

14. The golf bag of claim 2, wherein the back pad is substantially symmetric about a back pad axis, and the back pad axis is substantially perpendicular to a longitudinal axis of the enclosure.

15. The golf bag of claim 2, wherein the first shoulder strap first end connects with the body at a first location, and the second strap second end connects with the body at a second location, the first and second locations being located substantially along a longitudinal axis of the bag.

16. A golf bag comprising:

an enclosure, the enclosure having a top and a base at opposite ends of the enclosure with a body coupled there-between, the body having an outside surface;

a back pad being approximately symmetrical about a back pad axis wherein the back pad axis and a longitudinal axis of the enclosure are roughly perpendicular when the back pad is attached to the enclosure, the back pad comprising a lower back pad element, and a upper back pad element, the lower back pad element being attached with the body, the upper back pad element intersecting with the lower back pad element and extending away from the body, the upper back pad member further having a top edge, the top edge being intersected by the back pad axis;

a first shoulder strap having a first strap first end and a first strap second end, the first strap first end connected with the enclosure at a first location proximate the top, and the first strap second end connected with the top edge at a second location; and a second strap having a second strap first end and a second strap second end, the second strap first end connected with the top edge at a third location, and the second strap second end connected with the enclosure at a fourth location, wherein the second location Is spaced longitudinally from the first location, the third location is spaced longitudinally from the second location, and the fourth location is spaced longitudinally from the third location, said lower back pad element being attached with the body such that it covers a portion of the outside surface which would otherwise contact the back of a person when the bag is carried on the person by the first and second shoulder straps.

17. The golf bag of claim 16, further comprising at least one adjustable strap connected with the upper back pad element and the body, whereby the angle at which the upper back pad element extends away from the body may be varied.

18. The golf bag of claim 16, further comprising a handle, the handle being connected with the body at a location adjacent to the upper back pad member.

19. The golf bag of claim 17, wherein the upper back pad element is stiffened by a plate of rigid or semi-rigid material.

20. A golf bag comprising:

an enclosure, the enclosure having a top and a base at opposite ends of the enclosure with a body coupled there-between; and an integrated back pad/shoulder strap assembly, the integrated back pad/shoulder strap assembly comprising, a back pad, the back pad comprising a lower back pad element and an upper back pad element, the lower back pad element having a front padded surface and a back mounting surface opposite the front padded surface, the back mounting surface being connected with the body, the upper back pad element intersecting with the lower back pad element and extending away from the body, a first shoulder strap with a first end and a second end, the first end interfacing with the upper back pad element, the second end interfacing with the lower back pad element, and a second shoulder strap with first end and second end, the first end interfacing with the upper back pad element, the second end interfacing with the lower back pad element, said lower back pad element being connected with the body such that it covers a portion of an outside surface which would otherwise contact the back of a person when the bag is carried on the person by the first and second shoulder straps.

21. The golf bag of claim 20, wherein the lower back pad element is adjustably connected to the body by an adjustment connection system, the adjustment/connection system comprising:

one or more slides, the one or more slides attached to either the back mounting surface or the body; and one or more slide rails extending in a direction generally parallel with a longitudinal axis of the enclosure, the one or more slide rails attached to the other of the body or the back mounting surface depending on which the one or more slides are mounted, the one or more slides being moveably connected to a corresponding one of the one or more slide rails.

22. The golf bag of claim 21, wherein the lower back pad element is further adjustably connected to the body by hook and loop material with one surface, either the hook surface or the loop surface, attached to the back mounting surface and the other surface attached to the body.

23. The golf bag of claim 22, further comprising one or more pull straps attached to the lower back pad element, whereby the golfer may pull the pull straps while wearing the golf bag thereby releasing the hook and loop material, and permitting the golfer to move the back pad/shoulder strap assembly relative to the enclosure along the one or more slides and the one or more rails.

24. The golf bag of claim 21, wherein the slide rails comprise fabric webbing.

25. The golf bag of claim 20, wherein the lower back pad element is adjustably connected to the body by an adjustment/connection system, the adjustment/connection system comprising:

one or more daisy chain members extending in a direction generally parallel with a longitudinal axis of the enclosure, the one or more daisy chain members forming a plurality of adjacent loops when attached to either the back mounting surface or the body; and one or more clips attached to the other of the back mounting surface or the body, the clips having one or more prongs, each prong of the one or more prongs being received in one of the plurality of adjacent loops of a corresponding daisy chain member.

* * * * *